United States Patent [19]

Lazard

[11] Patent Number: 4,936,288

[45] Date of Patent: Jun. 26, 1990

[54] EXHAUST DEVICE FOR KITCHEN HOOD, AIR PURIFIER AND THE LIKE, AND HOOD COMPRISING SUCH A DEVICE

[75] Inventor: Georges Lazard, Strasbourg, France

[73] Assignee: Société d'Investissement et d'Innovation Industriels S. I.I.I., Ingwiller, France

[21] Appl. No.: 376,560

[22] Filed: Jul. 7, 1989

[30] Foreign Application Priority Data

Jul. 7, 1988 [FR] France ..... 88 09253

[51] Int. Cl.[5] ..... F24C 15/20

[52] U.S. Cl. ..... 126/299 D; 416/187; 416/178

[58] Field of Search ..... 126/299 R, 299 D, 301; 416/223 R, 223 B, 178, 187

[56] References Cited

U.S. PATENT DOCUMENTS

| | | | |
|---|---|---|---|
| 985,152 | 2/1911 | Fieroe | 416/178 |
| 1,633,609 | 6/1927 | Schmidt . | |
| 2,138,814 | 12/1938 | Bressler . | |
| 4,089,328 | 5/1978 | Bergmark et al. | 126/299 D |

FOREIGN PATENT DOCUMENTS

| | | |
|---|---|---|
| 548474 | 4/1932 | Fed. Rep. of Germany . |
| 1628196 | 4/1971 | Fed. Rep. of Germany . |
| 2271423 | 12/1975 | France . |

OTHER PUBLICATIONS

Patent Abstracts of Japan, vol. 6, No. 86 (M-131) (964), May 25, 1982.

Soviet Inventions Illustrated, section P/O. semaine 84/21, 4 Jul. 1984.

*Primary Examiner*—Carroll B. Dority

*Attorney, Agent, or Firm*—Hoffman, Wasson, Fallow & Gitler

[57] ABSTRACT

This invention relates to an exhaust device for a kitchen hood, air purifier and the like. It consists of a rigid flat disk (1), of a material impermeable to the gas flow, driven in rotation around its central axis by a drive means, said disk comprising on its front face turned toward the gas flow to be exhausted a plurality of projecting elements (2,3;2a,3a;2b,3b) arranged to form ducts (14) directing the exhausted gas flow in the direction of the periphery of said disk.

9 Claims, 2 Drawing Sheets

Figure 1:
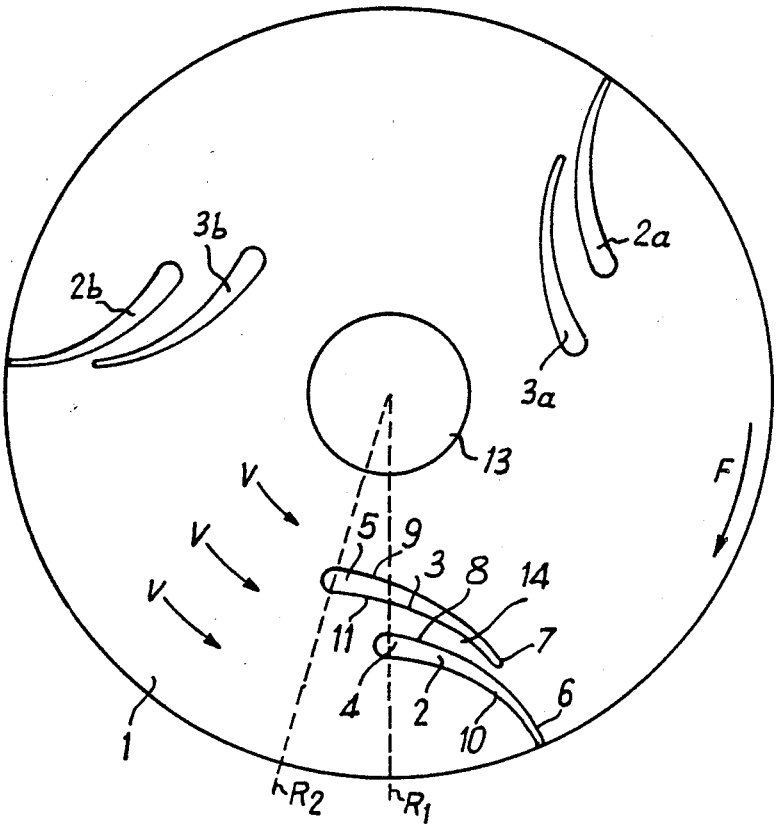

Fig. 3
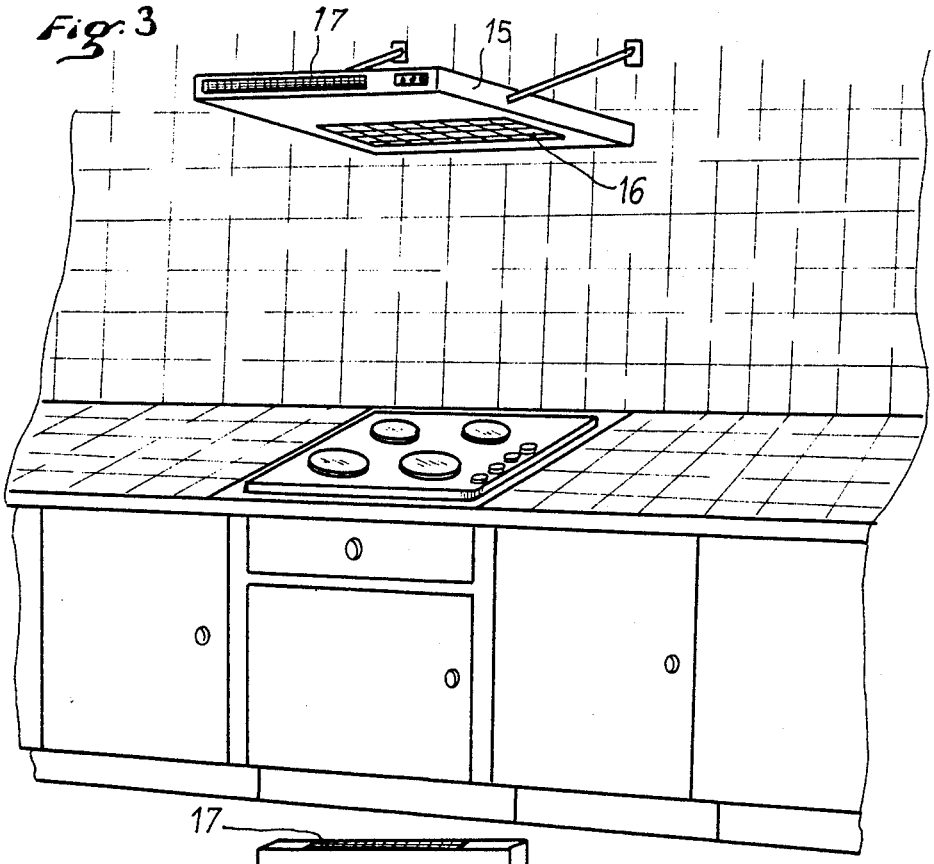
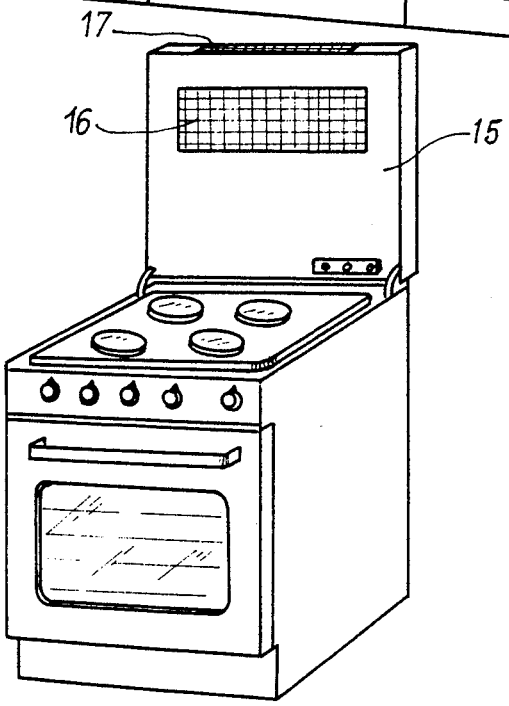
Fig. 4

EXHAUST DEVICE FOR KITCHEN HOOD, AIR PURIFIER AND THE LIKE, AND HOOD COMPRISING SUCH A DEVICE

This invention relates to an exhaust device for a kitchen hood, air purifier and the like.

Hoods generally placed above the cooking planes and intended to exhaust and filter cooking fumes are now used in kitchens.

In modern kitchen installations, the hoods comprise an exhaust device in the form of a exhaust fan or turbine, driven by a motor and arranged to achieve a partial vacuum making it possible to draw upward, in a gas current, the cooking fumes which are made to go through a system of filters, comprising particularly antigrease filters and, in the case of a so-called recycling hood, a filter fixing the odors in particular to activated carbon, the unit being placed in the hood upstream from the exhaust device.

Unless very great powers are used, with the associated drawbacks, particularly at the noise level, present exhaust devices have only relatively weak exhaust capacities, decreasing more with the pressure drop caused by clogging of the filter system.

Further, by their configuration, present exhaust devices exhibit a considerable overall height, so that hoods equipped with these exhaust devices generally have a considerable height and occupy space in the kitchen that could be usefully allocated to other uses, particularly storage.

This invention is proposed to provide an exhaust device for kitchen hoods and the like exhibiting a considerable exhaust power and a particularly reduced overall height.

The device according to the invention is essentially characterized by the fact that it consists of a rigid plane disk, of a material impermeable to the gas flow, driven in rotation around its central axis by a drive means, said disk comprising, on its front face turned toward the gas flow to be exhausted, a plurality of projecting elements arranged to form ducts directing the exhausted gas flow in the direction of the periphery of said disk.

According to the invention, the projecting elements consist of pairs of vanes in the form of shaped blades fastened to the front face of said disk, perpendicular to it, each of the vanes exhibiting a profile narrowing from a thicker leading edge to a thinner trailing edge, the extrados wall of each vane at the level of its leading edge being approximately perpendicular to the radius of the disk passing through said leading edge, the vanes of the same pair being placed to make between them a duct in the shape of a funnel converging in the direction of the periphery of the disk.

Preferably, the vanes of the same pair are angularly spaced, the leading edge of the inside vane of each pair, i.e., the vane closest to the center of the disk, being located ahead of the leading edge of the outside vane in the direction of rotation of said disk.

The gas flow is thus channeled at the level of each pair of vanes along the intrados wall of the inside vane, between the intrados wall of the inside vane and the extrados of the outside vane in the funnel-shaped duct made between said vanes, then along the extrados wall of the outside vane to the periphery of the disk.

Advantageously, the end of the trailing edge of the outside vane is placed close to the periphery of the disk.

According to the invention, it is advantageous to provide between three and six pairs of vanes and in particular three pairs of vanes, distributed at equal angles around the disk.

The maximum height of the exhaust device according to this first embodiment corresponds to the height of the vanes added to the thickness of the disk and to the height of the part of the motor projecting beyond the back face of the disk. In practice, this cumulative height can be kept below 5 cm, thus making it possible to achieve an extra flat hood.

The hood made according to the invention comprises, for housing the exhaust device, a housing, preferably parallelepipedic in shape, whose section is slightly greater than the surface of the disk, equipped on its front face, upstream from the exhaust device, with a filter system, particularly in the form of a layer of activated carbon filtering material.

The parallelepipedic housing can advantageously comprise, around the disk, a set of cavities intended to reduce the operating noise of the hood resulting from the rotation of the disk. For this purpose, the cavities can be made to be acoustically in phase opposition.

The motor used in the exhaust device according to the invention can be any suitable type having small dimensions, and particularly a dc motor able to be housed in a recess made in the center of the disk.

Figure 2:
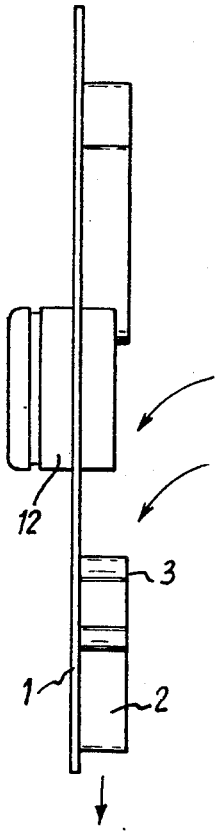

For a better understanding of the invention, two embodiments that are in no way limiting will now be described with reference to the accompanying drawing in which:

FIG. 1 is a diagrammatic plan view of a first embodiment of the exhaust device according to the invention, FIG. 2 is a diagrammatic elevation view of the device of FIG. 1, FIGS. 3 and 4 illustrate possible assemblies of a kitchen hood equipped with the exhaust device of FIGS. 1 and 2.

Reference is made to FIGS. 1 and 2.

In this embodiment the exhaust device comprises a flat rigid plastic or metal disk 1, whose section corresponds approximately to the section of a cooking plane. Three pairs of vanes in the form of shaped blades 2, 3 and/or *2a*, *3a* and *2b*, *3b*, are mounted on the front face of this disk 1.

The structure and functioning of the pair of vanes 2, 3, with now be described, it being understood that the structure and functioning of the pairs of vanes *2a*, *3a* and/or *2b*, *3b* are identical.

Vanes 2 and 3 each exhibit the form of a shaped blade with a leading edge for each vane 4 and/or 5 thicker than the trailing edge 6 and/or 7.

The vanes are placed to project on the corresponding face of the disk so that their extrados walls 8 and/or 9 and their intrados walls 10 and/or 11 are perpendicular to the surface of the disk. Vanes 2 and 3 can be made integral with disk 1 or be attached to it, for example, at the level of their leading edge.

As can be seen in the drawing, vanes 2 and 3 are mounted on the disk so that their extrados wall 8, 9 at the level of their leading edges 4 and/or 5 are approximately perpendicular to radii R1 and/or R2 of the disk passing through these leading edges.

Further, leading edge 5 of inside vane 3 is placed ahead of leading edge 4 of outside vane 2 in the direction of rotation of the disk indicated by arrow F.

In practice, the value of this angular offset is about half the angular distance between the end of the leading edge of a vane and the end of its trailing edge.

Arrows V in FIG. 1 indicate the relative wind resulting from the rotation of the disk. This rotation is caused by motor 12 (FIG. 2) placed in a recess 13 (FIG. 1) made in the center of the disk.

The motor according to the invention is particularly a small-size dc motor, in particular of the type comprising a disk-shaped rotor in which induction coils, wound flat and buried in resin, are housed.

In practice, the motor is supplied from the electric network by a transformer (not shown).

Because of the rotation of the disk, there is produced, from the center of the latter, a suction by partial vacuum on the extrados walls of inside vanes 3,3*a* and 3*b*, the gas flow being channeled at the level of each pair of vanes in a duct 14 in the shape of a funnel converging to the periphery of the disk.

In an embodiment with a disk of aluminum alloy with a diameter of 30 cm and a thickness of 1 mm and with vanes with a height of 3 cm from the front face of the disk, there were obtained partial vacuum values of 60 mm of a water column, notably greater than the values traditionally obtained with conventional exhaust devices for kitchen hoods.

The total height of the device makes it possible to house the latter in a parallelepipedic housing 15 exhibiting a total height less than 5 cm to achieve an integrated hood. A layer of filtering material is placed in a way known in the art in the housing constituting the hood upstream from the front face of the disk equipped with vanes to retain the residues, particularly greasy cooking residues contained in the fumes that are exhausted through a front opening of housing 16. The purified fumes are evacuated by openings 17 made in the side faces of the housing.

The hood made according to the invention can be mounted stationary, in a conventional way, above a cooking plane, the disk being placed horizontal (FIG. 3). Considering its particularly reduced overall height, the hood according to the invention can also be integrated into the pivoting cover of a range or cooking plate (FIG. 4) or also can be placed horizontal under the cooking plane, the fumes coming from the cooking then being channeled from the top of the cooking plane to the front face of the exhaust device.

Although the invention has been described in connection with particular embodiments, it is quite evident that it is in no way limited to them and that numerous variants and modifications can be made in it without thereby going outside its scope and spirit. Further, the exhaust device according to the invention is not limited to the use in kitchen hoods but can also be used, for example, in exhausting hoods of laboratories and more generally by extraction by exhausting fumes generated by a combustion.

What is claimed:

1. Exhaust device for a kitchen hood, air purifier and the like consisting of a rigid plane disk, of a material impermeable to the gas flow, driven in rotation around its central axis by a drive means, characterized in that said disk (1) comprises, on its front face turned toward the gas flow to be exhausted, a plurality of projecting elements consisting of pairs of vanes (2,3;2*a*,3*a*;2*b*,3*b*) in the form of shaped blades fastened to the front face of said disk, perpendicular to it, each of the vanes exhibiting a profile narrowing from a thicker leading edge (4;5) to a thinner trailing edge (6;7), extrados wall (8,9) of each vane at the level of leading edge (4,5) being approximately perpendicular to radius (R1,R2) of the disk passing through said leading edge, the vanes of the same pair being placed to make between them a duct (14) in the shape of a funnel converging in the direction of the periphery of the disk to direct the exhausted gas flow in the direction of the periphery of the disk.

2. Device according to claim 1, wherein vanes (2,3) of the same pair are angularly spaced, leading edge (5) of inside vane (3) of each pair being located ahead of leading edge (4) of outside vane (2) in direction of rotation (F) of said disk.

3. Device according to claim 1, wherein the end of trailing edge (6) of outside vane (2) of each pair is placed close to the periphery of the disk.

4. Device according to claim 1 including at least three pairs of vanes distributed at equal angles around the disk.

5. Device according to claim 1, wherein the drive means is a dc motor (12) housed in a recess (13) made in the center of disk (1).

6. A kitchen including the exhaust device of claim 1.

7. A kitchen hood according to claim 6, wherein the exhaust device is housed in a housing, particularly parallelepipedic in shape (15), whose section is slightly greater than the surface of disk (1) of the exhaust device, said housing comprising, upstream from the exhaust device, a filter system, particularly in the form of a layer of activated carbon filtering material.

8. Kitchen hood according to claim 6, wherein it is mounted stationary above a cooking plane, disk (1) of the exhaust device being placed horizontal and rotating around a vertical axis.

9. Kitchen hood according to claim 6, wherein the kitchen hood forms a pivoting cover of a range or cooking plate.

* * * * *